US008049578B1

(12) United States Patent
Albers et al.

(10) Patent No.: US 8,049,578 B1
(45) Date of Patent: Nov. 1, 2011

(54) AIR LOADED STRIPLINE

(75) Inventors: Luke J. Albers, Thornton, CO (US); Dean A. Paschen, Lafayette, CO (US)

(73) Assignee: Ball Aerospace & Technologies Corp., Boulder, CO (US)

( * ) Notice: Subject to any disclaimer, the term of this patent is extended or adjusted under 35 U.S.C. 154(b) by 204 days.

(21) Appl. No.: 12/542,328

(22) Filed: Aug. 17, 2009

(51) Int. Cl.
*H01P 3/08* (2006.01)
*H01P 1/203* (2006.01)

(52) U.S. Cl. ..... 333/134; 333/204

(58) Field of Classification Search ..... 333/134, 333/204, 246
See application file for complete search history.

(56) References Cited

U.S. PATENT DOCUMENTS 4,414,550 A 11/1983 Tresselt
5,281,934 A * 1/1994 Shiau et al. ..... 333/134
5,363,067 A * 11/1994 Crandall et al. ..... 331/107 SL
5,712,607 A * 1/1998 Dittmer et al. ..... 333/238
6,118,355 A * 9/2000 Pelz et al. ..... 333/134
6,121,929 A 9/2000 Olson et al.
6,608,535 B2 * 8/2003 Sherman et al. ..... 333/128
6,741,212 B2 5/2004 Kralovec et al.
7,663,064 B2 * 2/2010 Dutta et al. ..... 174/261
7,755,457 B2 * 7/2010 Lee et al. ..... 333/204
2007/0262836 A1 * 11/2007 Voss ..... 333/247

OTHER PUBLICATIONS

Menzel et al., "Quasi-Lumped Element Suspended Stripline Filters for Integration into Microstrip Circuits", Microwave Review, University of Ulm, Jun. 2007, 6 pages.
Lau et al., "Suspended Microstrip Patch Antenna With Ground-shield Tapered Suspended Stripline Feed", 33rd European Microwave Conference, Microwave Engineering Group, UMIST, 2003, 3 pages.

* cited by examiner

*Primary Examiner* — Seungsook Ham
(74) *Attorney, Agent, or Firm* — Sheridan Ross P.C.

(57) ABSTRACT

Air loaded stripline assemblies and methods for providing same are disclosed. The air loaded stripline assembly includes circuit board layers interconnected to one another. A layer containing a conductive trace forming a stripline is connected to spacer layers. The spacer layers include voids or relieved areas, that define cavities adjacent areas of the stripline layer on which the stripline is formed. Ground plane layers are interconnected to the spacer layers, bounding the cavities. The air loaded stripline assembly can additionally incorporate conductive vias for electrically interconnecting the stripline to other components or assemblies. The air loaded stripline assembly can be formed using conventional printed circuit board techniques.

19 Claims, 6 Drawing Sheets

AIR LOADED STRIPLINE

FIELD

An air loaded stripline is provided. More particularly, an air loaded stripline that can be included in a diplexer and that features circuit board elements is provided.

BACKGROUND

Dual-band antennas have many applications. For example, systems in which transmit and receive modes are separated in bandwidth are in use or have been proposed. In systems that feature dual-band operation, it is desirable to provide a single antenna aperture that supports both a transmit and receive modes. In order to operate in different bands through a single aperture, diplexers have been used. In concept, diplexers separate the bandwidth of a wide band radiating structure into two narrower bands. Diplexers typically feature filters that selectively feed low and high frequency radiating elements.

Diplexers can be difficult and expensive to implement. For example, one diplexer design that has been used includes ceramic resonator type filters. However, ceramic resonators are heavy and expensive. In addition, they are more bandwidth limited than other designs. For example, they are difficult or impossible to implement at high frequencies (e.g., greater than C band).

Diplexers have also been developed that feature air loaded, suspended stripline filters. These can provide low insertion loss, wide bandwidth, and high rejection. However, air loaded stripline elements have been difficult and expensive to implement. In a typical air loaded stripline element, a conductive element is suspended within a metallic cavity or shielding structure. Such filters have typically been implemented as discrete components that are interconnected to other circuit components, for example through coaxial connectors. As a result, integration with other circuit components can be difficult. As an alternative, designs have been proposed in which transmission line structures are printed on a substrate that is suspended in a shielding channel. Although providing transmission lines in this way can facilitate integration of the stripline within larger circuits, such designs do not avoid the need to encase or surround the stripline within a metal channel. This has been realized using a bottom metallic piece having a groove on one side of the stripline and a metallic cap on the opposite side of the stripline. Accordingly, the filter is relatively difficult and thus expensive to manufacture, and requires the use of a number of different fabrication technologies.

SUMMARY

Embodiments of the disclosed invention are directed to solving these and other problems and disadvantages of the prior art. In particular, an air loaded stripline is provided. The air loaded stripline features the use of conventional circuit board elements. As a result, the air loaded stripline, which can be used in connection with various circuits, including a diplexer, is economical to produce as compared to other technologies, and can be integrated with other circuit components.

In accordance with embodiments of the disclosed invention, the air loaded stripline can be produced using conventional printed circuit board (PCB) techniques. As used herein, the term "printed circuit board" or "PCB" is not limited to circuit boards that are printed or that use printing techniques. Accordingly, in addition to printing, photo etching in combination with photo resist masks, or other techniques that include an element of printing, embodiments of the disclosed invention can be produced utilizing chemical or mechanical etching or any other technique that can be used to produce a circuit trace on a substrate.

In accordance with embodiments of the disclosed invention, an air loaded stripline is produced by creating a conductive trace (the stripline) on a substrate. Spacer elements are positioned on either side of the substrate carrying the stripline. The spacer elements can be in the form of frames surrounding voids. In particular, the spacer elements comprise voids in areas corresponding to the air loaded portion of the stripline in the completed element. On a side of each spacer opposite the substrate and stripline are ground planes. The ground planes may comprise circuit board material that includes a conductive layer and a dielectric substrate.

In accordance with further embodiments of the disclosed invention, a single layer of the circuit board material may comprise a plurality of striplines or conductive elements. For example, a stripline for a high pass filter element and a stripline for a low pass filter element may be formed on or as part of the same circuit board. In addition, an air loaded stripline component in accordance with embodiments of the disclosed invention can include more than one layer of circuit board material on which striplines are formed. A stack of circuit boards from which an air loaded stripline is formed can additionally include layers with traces supporting other functions, such as connectivity and power distribution functions. In addition, circuit boards at the ends of a stack can provide for connectivity to other components through connectors, or through providing pads or other fixtures to which discreet components can be mounted.

In accordance with embodiments of the present invention, an air loaded stripline diplexer is formed using known circuit board or printed circuit board techniques. Accordingly, conductive traces comprising one or more air loaded striplines can be formed on a printed circuit board. On either side of the printed circuit board, spacer boards having material removed or relieved from areas adjacent the portions of the stripline that are to be air loaded are connected to either side of the board having the conductive striplines. Circuit boards functioning as ground planes can be interconnected to the spacer elements, thus forming cavities on either side of the stripline. Additional air loaded striplines can be formed in the same manner by adding additional layers, for example to provide multiple diplexers. Other circuit elements can also be included, for example by interconnecting circuit boards containing connective traces and/or attachment points for connecting the component to other electronic components and/or to provide mounting points for discreet components. Moreover, conductive vias, for example to connect other circuit elements to the air loaded striplines, can be provided.

Additional features and advantages of embodiments of the disclosed invention will become more readily apparent from the following description, particularly when taken together with the accompanying drawings.

DETAILED DESCRIPTION

Figure 1:
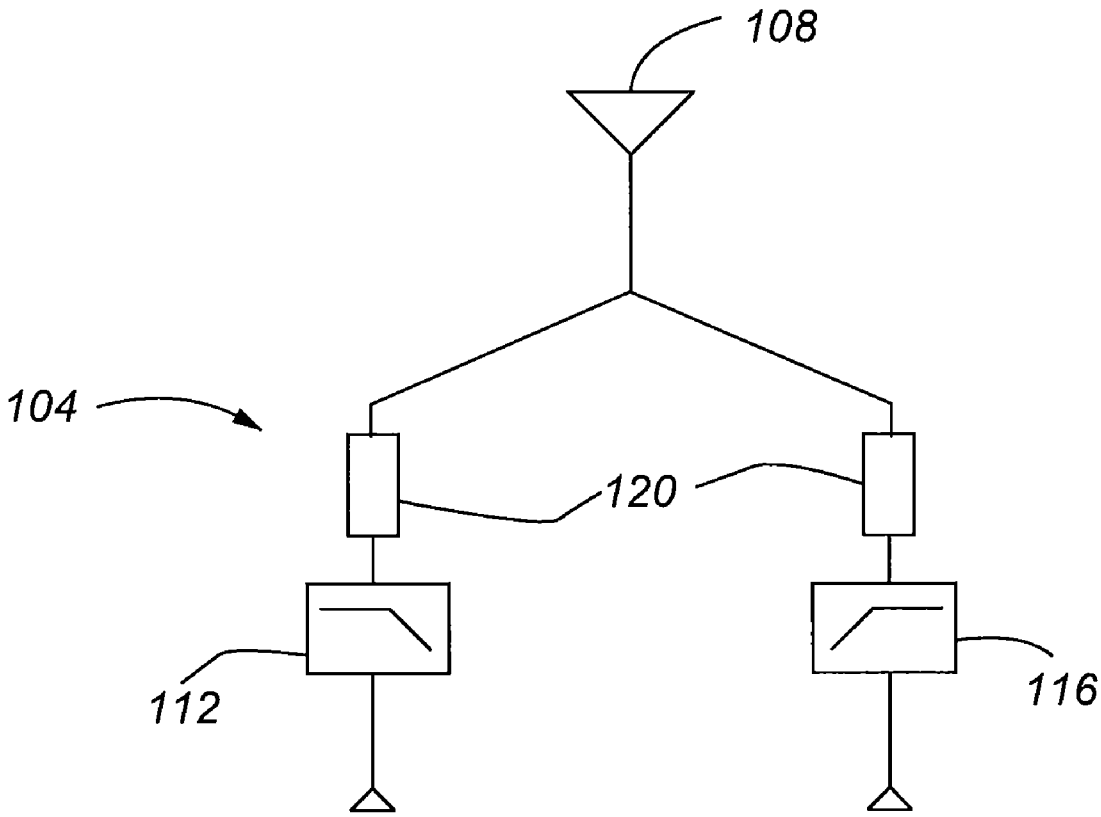
FIG. 1 is a depiction of a diplexer circuit.

FIG. 1 depicts a diplexer circuit 104 interconnected to an antenna element 108. The diplexer circuit 104 generally includes a low pass filter 112 and a high pass filter 116. An impedance transformer 120 may be associated with each of the filters 112 and 116. The filters 112, 116 may in turn be interconnected to associated circuitry. In particular, circuitry interconnected to the low pass filter 112 is associated with signals transmitted with respect to the antenna element 108 within a relatively low range of frequencies, while circuitry interconnected to the high pass filter 116 is associated with signals transmitted with respect to the antenna element 108 within a relatively high bandwidth. The design of the filters 112, 116 can often be facilitated by the inclusion of air loaded stripline, for example as is provided by embodiments of the present invention.

Figure 2:
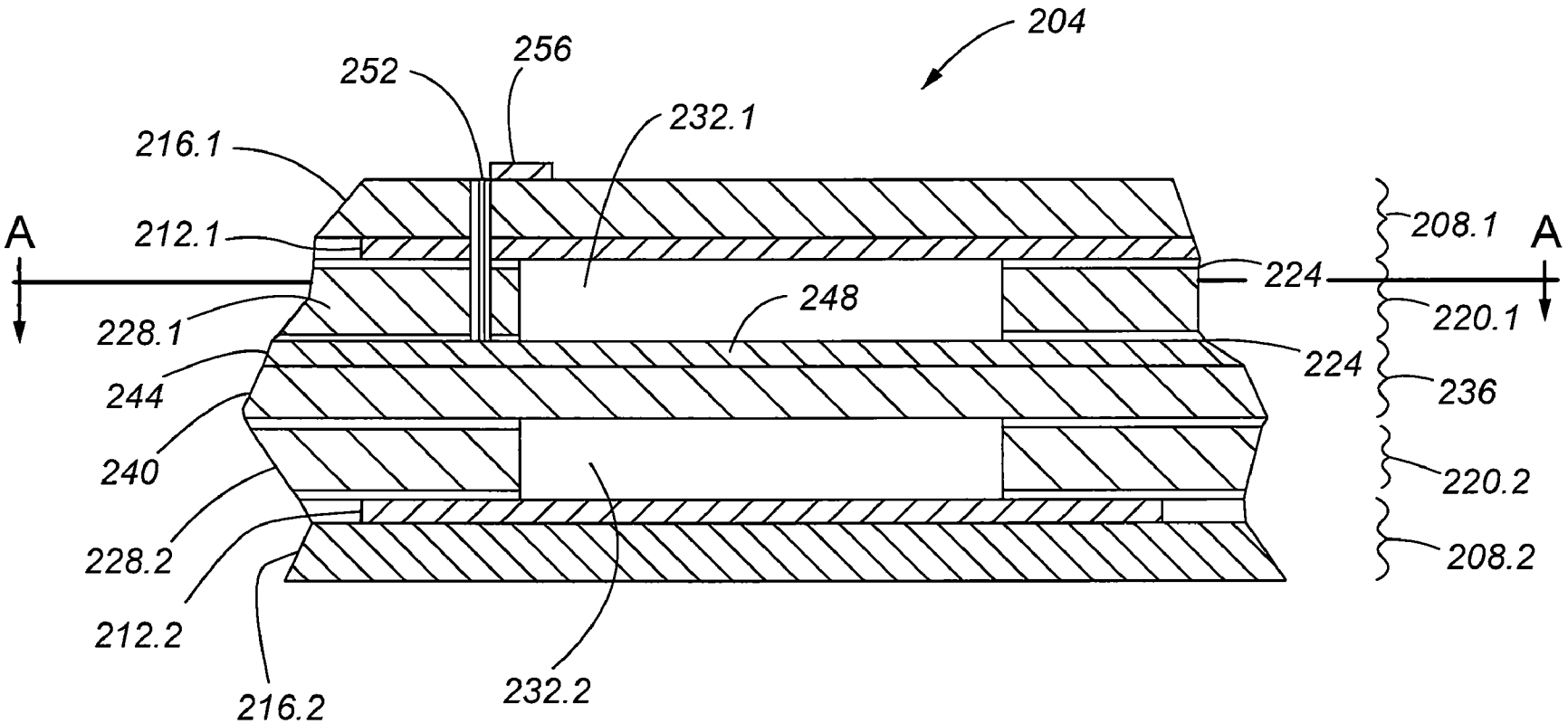
FIG. 2 is a cross-section of an air loaded stripline assembly in accordance with embodiments of the disclosed invention.

FIG. 2 is a cross-section of an air loaded stripline assembly 204 in accordance with embodiments of the present invention. The air loaded stripline assembly 204 may, but need not, be included in a filter, such as a filter 112 and 116 incorporated into a diplexer circuit 104. In general, the air loaded stripline assembly 204 in accordance with embodiments of the present invention comprises a stack or assembly of printed circuit boards (PCBs). As noted elsewhere, although the term printed circuit board or PCB will be used for convenience of description, it should be appreciated by one of skill in the art that embodiments of the present invention are not necessarily limited to the use of laminated circuit boards created using printing techniques. For example, circuit boards that have been patterned using photoengraving, chemical or mechanical etching, milling, or plating may be utilized in producing an air loaded stripline assembly 204 in accordance with embodiments of the present invention. In particular, any structure in which a substrate is combined with one or more conductive layers in a planar configuration is included in the term printed circuit board. In accordance with further embodiments, flexible substrates and associated or interconnected conductive layers are included in the term printed circuit board or PCB. Moreover, traces or other features in the conductive layer or layers can be formed by any method.

The air loaded stripline assembly 204 includes a first ground plane layer 208.1 that comprises a ground plane 212.1 and an associated substrate 216.1. A first side of the first ground plane layer 208.1 is interconnected to a first spacer layer 220.1, for example by an adhesive 224. The first spacer layer 220.1 comprises a substrate 228.1, with a void or cutout, to form a first cavity 232.1 in the assembled air loaded stripline assembly 204 that is bounded on one side by the first ground plane layer 208.1. The first spacer layer 220.1 is interconnected to a first side of a first stripline layer 236. The first stripline layer 236 includes a substrate 240 and an interconnected conductive trace or traces 244, including at least one stripline 248. The stripline layer 236 may be interconnected to the first spacer layer 220.1 by an adhesive 224. As shown in the figure, the stripline 248 is adjacent to the first cavity 232.1 formed by the void in the spacer layer 220.1. Accordingly, the stripline 248 is air loaded on a first side.

A second spacer layer 220.2 is interconnected to a second side of the first stripline layer 236. The second spacer layer includes a substrate 228.2 in which a void or cutout is formed, to create a second cavity 232.2 on a second side of the stripline layer 236. Accordingly, the stripline 248 is effectively air loaded on a second side. A first side of the second spacer layer 228.2 may be interconnected to the second side of the stripline layer 236 by an adhesive 224. A second ground plane layer 208.2 is interconnected to a second side of the second spacer layer 228.2. The second ground plane layer 208.2 includes a conductive layer 212.2 interconnected to a substrate 216.2. In particular, the second ground plane layer 208.2 includes ground plane material 212.2 adjacent the area of the stripline layer 236 containing the stripline 248. In addition, it can be seen that the second cavity 232.2 formed on a second side of the stripline layer 236 adjacent the stripline 248 is bounded on one side by the second ground plane layer 208.2. Accordingly, the stripline 248 is air loaded on a second side.

In order to facilitate the interconnection of various conductive elements to one another, various techniques may be used, including the provision of conductive vias, such as the conductive via 252 shown interconnecting the stripline 248 to a component pad 256 on a second side or surface of the first ground plane layer 208.1 substrate 216.1, opposite the conductive ground plane 212.1. As can be appreciated by one of skill in the art, the component pad 256 may be used to interconnect a discrete component or another circuit element, to allow the signals to be passed between the component or element and the stripline 248. Moreover, the component pad 256 can be just one of a number of features or traces formed on the second side of the first ground plane layer 208.1. Accordingly, the first ground plane layer 208.1 is an example of a PCB with multiple conductive layers.

Figure 3:
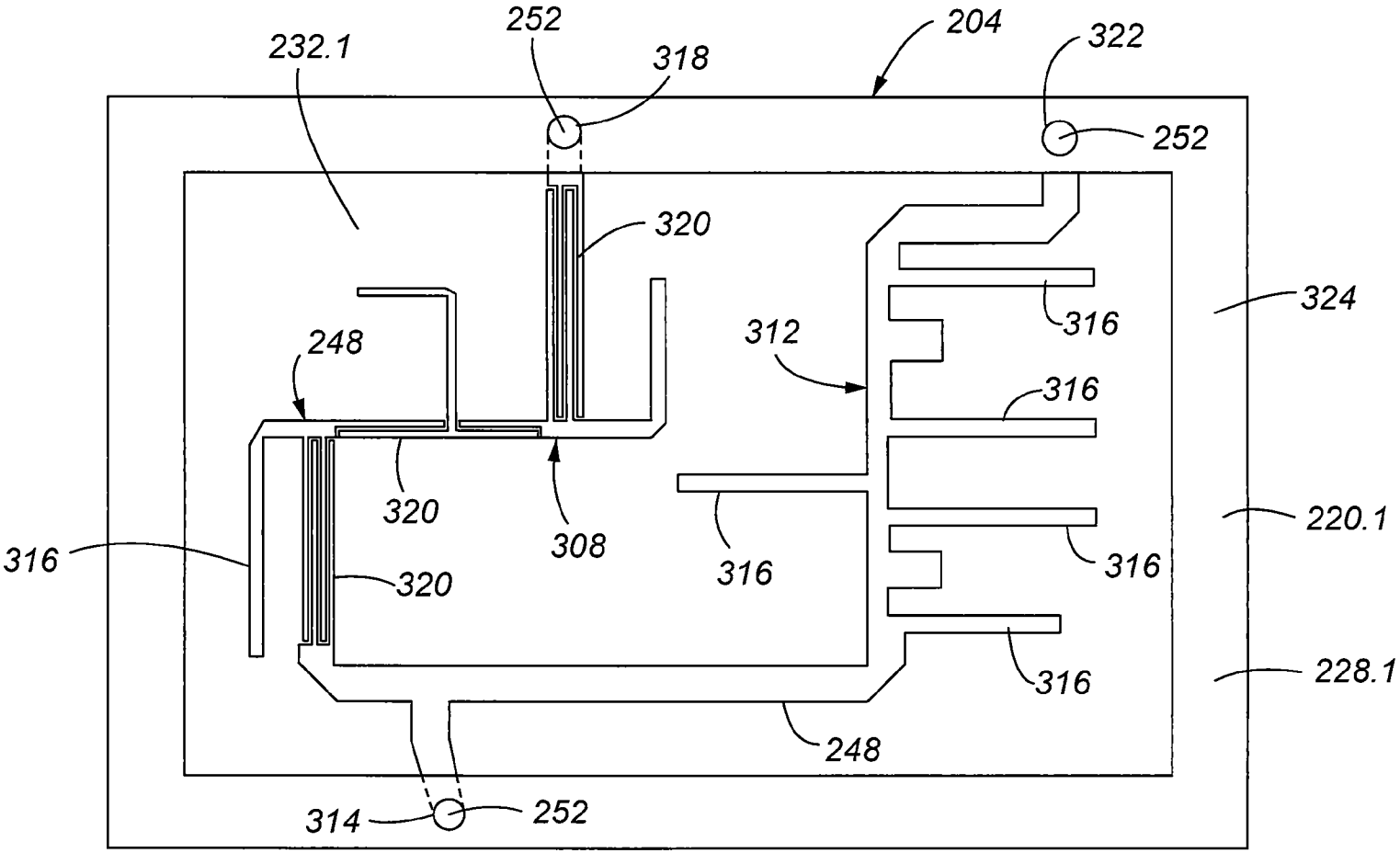
FIG. 3 is a plan view of an air loaded stripline assembly in accordance with embodiments of the disclosed invention.

FIG. 3 depicts the air loaded stripline assembly 204 in accordance with the exemplary embodiment of the present invention illustrated in FIG. 2 in plan view along section line A-A in FIG. 2. In particular, FIG. 3 shows that the stripline 248 may comprise a first branch 308 and a second branch 312 that extend from a common port 314 associated with one of the vias 252. In accordance with embodiments of the present invention in which the air loaded stripline assembly 204 is associated with a diplexer circuit 104, the first branch 308 may be associated with a low pass filter 112 that is connected to a low pass filter port 318, and the second branch 312 may be associated with a high pass filter 116 that is connected to a high pass filter port 322. In addition, each of the branches 308 and 312 can include a number of features, such as open circuited stubs 316. Other circuit features that can be incorporated include inter-digital capacitors 320, for example as shown in connection with the branch associated with the high pass filter 116. Other features that can be incorporated into the stripline 248 include changes in width, length, geometry, and interdigital spacing.

FIG. 3 shows that the stripline 248 is open to the first cavity 232.1 formed within a frame 324 around or corresponding to the perimeter of the first spacer layer's 220.1 substrate 228.1. In addition, it can be seen that conductive vias 252 extend through the frame 324 formed around the perimeter of the first spacer layer 220.1. Accordingly, it can be appreciated that embodiments of the present invention facilitate the provision of air loaded striplines 248 in complex geometric configurations, as the stripline 248 can be produced using printed circuit board techniques.

Figure 4:
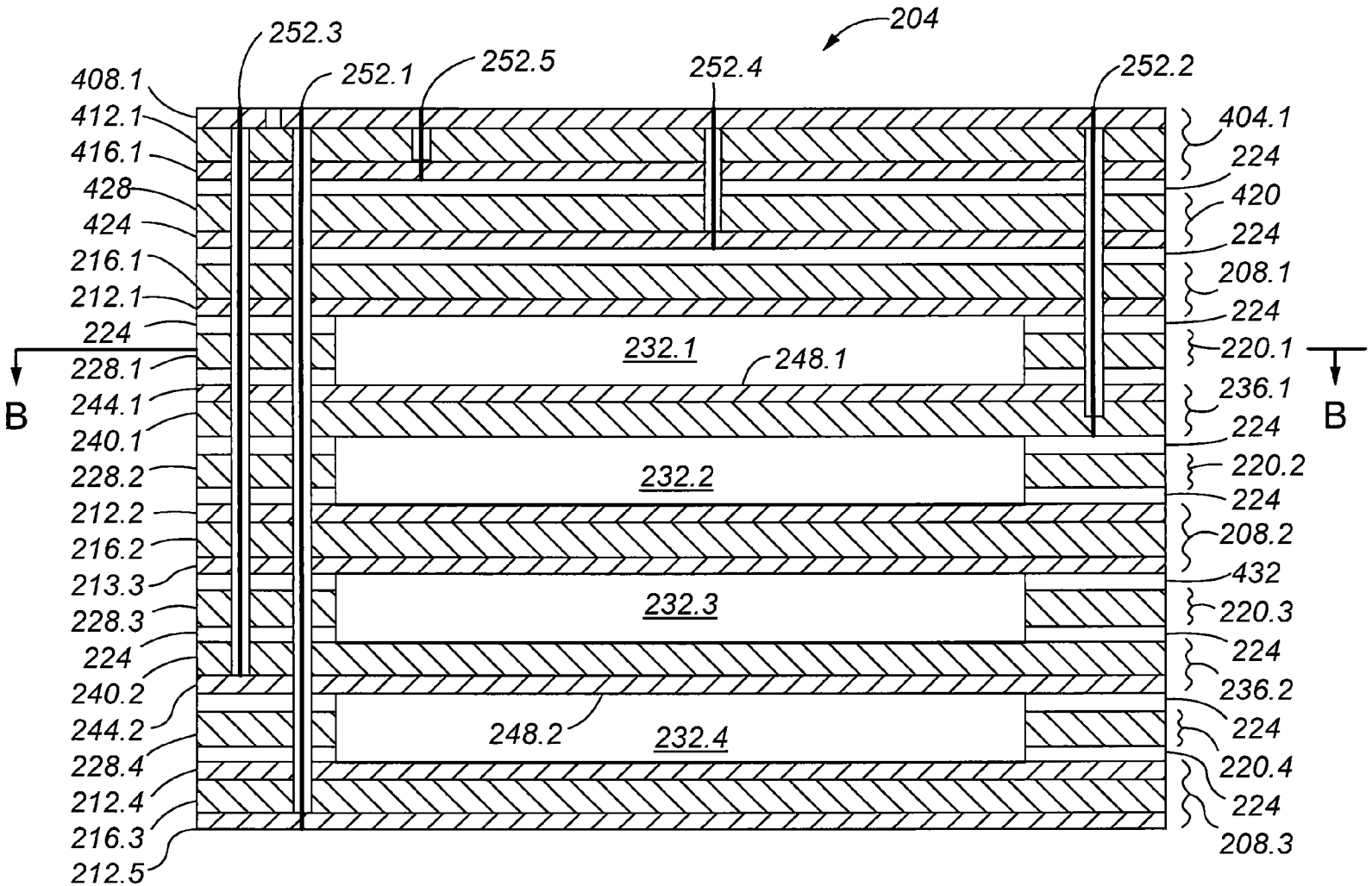
FIG. 4 is a cross-section of an air loaded stripline assembly incorporating multiple stripline layers in accordance with embodiments of the disclosed invention.

FIG. 4 is a cross-section of an air loaded stripline assembly 204 in accordance with further embodiments of the present invention. In general, the air loaded stripline assembly 204 includes a first circuit layer 404.1. The first circuit layer 404.1 can comprise a circuit element conductive layer 408.1 interconnected to a first side of a substrate 412.1. The circuit element conductive layer 408.1 can include traces for providing power and control signal distribution to components or elements of the air loaded stripline assembly 204, and/or to other interconnected circuit elements. For example, the circuit element conductive layer 408.1 can provide pads for receiving discrete surface mount components or connectors. A ground plane 416.1 can be interconnected to a second side of the substrate 412.1.

The first circuit layer 404.1 can be interconnected to a power and control layer 420. The power and control layer 420 generally includes a power and control circuit trace layer 424 interconnected to a substrate 428. A first side of the power and control layer 420 can be bonded to the second side of the first circuit layer 404.1 by an adhesive 224.

A second side of the power and control layer 420 can be bonded to a first side of a first ground plane layer 208.1, for instance using an adhesive 224. The first ground plane layer 208.1 generally includes a substrate 216.1 and an interconnected conductive ground plane 212.1. On a second side, the first ground plane layer 208.1 may be bonded to a first side of a first spacer layer 220.1. The first spacer layer 220.1 includes a substrate 228.1, with a void or cutout, to form a cavity 232.1 in the assembled air loaded stripline assembly 204.

Attached to a second side of the first spacer layer 220.1 is a first stripline layer 236.1. The first stripline layer 236.1 includes a substrate 240 and an interconnected conductive trace or traces 244, including at least a first stripline 248.1. The first stripline 248.1 is adjacent the cavity 232.1 formed by the first spacer layer 220.1 between the substrate 240 of the first stipline layer 236.1 and the ground plane 212.1 of the first ground plane layer 208.1. A first side of a second spacer layer 220.2 is interconnected to a second side of the first stripline layer 236.1. The second spacer layer 220.2 includes a substrate 228.2, with a void or cutout to create a second cavity 232.2 on the second side of the stripline layer 236.1. More particularly, the second cavity 232.2 is adjacent at least a portion of the first stripline 248.1. Accordingly, it can be appreciated that, by creating cavities 232.1 and 232.2 on either side of the first stripline layer 236.1 in areas corresponding to the location of a first stripline 248.1, the first stripline 248.1 is air loaded.

A first side of a second ground plane layer 208.2 is interconnected to a second side of the second spacer layer 220.2, for example by an adhesive 224. The second ground plane layer 208.2 includes a first conductive ground plane 212.2 on a first side of a substrate 216.2, and a second conductive ground plane 212.3 on a second side of the substrate 216.2. A first side of a third spacer layer 220.3 is interconnected to the second side of the second ground plane layer 208.2. The third spacer layer 220.3 includes a substrate 228.3 with a relieved section or cutout portion that defines a third cavity 232.3.

A first side of a second stripline layer 236.2 is interconnected to the second side of the third spacer layer 220.3. The second stripline layer 236.2 generally includes a substrate 240.2 and an interconnected conductive trace or traces 244.2, that include at least one stripline 248.2. A first side of a fourth spacer layer 220.4 is interconnected to the second side of the second stripline layer 236.2. The fourth spacer layer 220.4 includes a substrate 228.4 with a cutout or relieved portion that defines a fourth cavity 232.4. As shown, the third cavity 232.3 on a first side of the second stripline layer 236.2 and the fourth cavity 232.4 on a second side of the second stripline layer 236.2 are adjacent the second stripline 248.2 formed on the second stripline layer 236.2. Accordingly, the second stripline 248.2 is an air loaded stripline. A first side of a third ground plane layer 208.3 is interconnected to a second side of the fourth spacer layer 220.4. The third ground plane layer 208.3 includes a conductive ground plane 212.4 interconnected to a first side of a substrate 216.3 and a conductive ground plane 212.5 interconnected to a second side of the substrate 216.3. Accordingly, the relieved portion of the fourth spacer layer 220.4 combines with the third ground plane layer 208.3 to define the fourth cavity 232.4 adjacent a second side of the second stripline 248.2.

The stripline assembly 204 may also include a number of conductive vias 252. In general, the conductive vias 252 allow conductive elements or circuit devices to be electrically interconnected to other conductive elements, such as striplines 248, at different layers of the air loaded stripline assembly 204. Moreover, the conductive vias 252 can be located such that they pass through the frame or periphery of spacer layers 220, where the via 252 interconnects layers or elements on opposite sides of a cavity 232 defined by a spacer layer 220. For example, a first conductive via 252.1 may interconnect the various ground planes 212 to one another and to a circuit ground. A second conductive via 252.2 may interconnect traces and/or components formed on the first circuit layer 404.1 to an input (or an output) and of the first stripline 248.1 of the first stripline layer 236.1. In general, a complimentary via 252 will interconnect the opposite end of the first stripline 248.1 to traces and/or circuit elements formed on the first circuit layer 404.1. Similarly, a third conductive via 252.3 may interconnect traces and/or components formed on the first circuit layer 404.1 to an end of the second stripline 248.2 formed as part of the second stripline layer 236.2. Again, another conductive via at an end of the second stripline 248.2 opposite the end to which the third conductive via 252.3 is connected will be provided to interconnect the second end of the second stripline 248.2 to circuit traces and/or devices formed as part of the first circuit layer 404.1. Additional vias 252.4 and 252.5 are also shown. The via 252.4 extending from the circuit element conductive layer 408.1 of the first circuit layer 404.1 to the power and control layer 420 is an example of a via that can be used to provide power distribution or a control signal channel. The via 252.5 extending between the circuit element conductive layer 408.1 and the ground plane layer 416.1 of the first circuit layer 404.1 may provide a connection to ground. The conductive vias 252 may be formed using conventional printed circuit board technologies. In addition, the various layers of the assembly 204 can be joined to one another conventionally, for example by using an adhesive 224.

Figure 5:
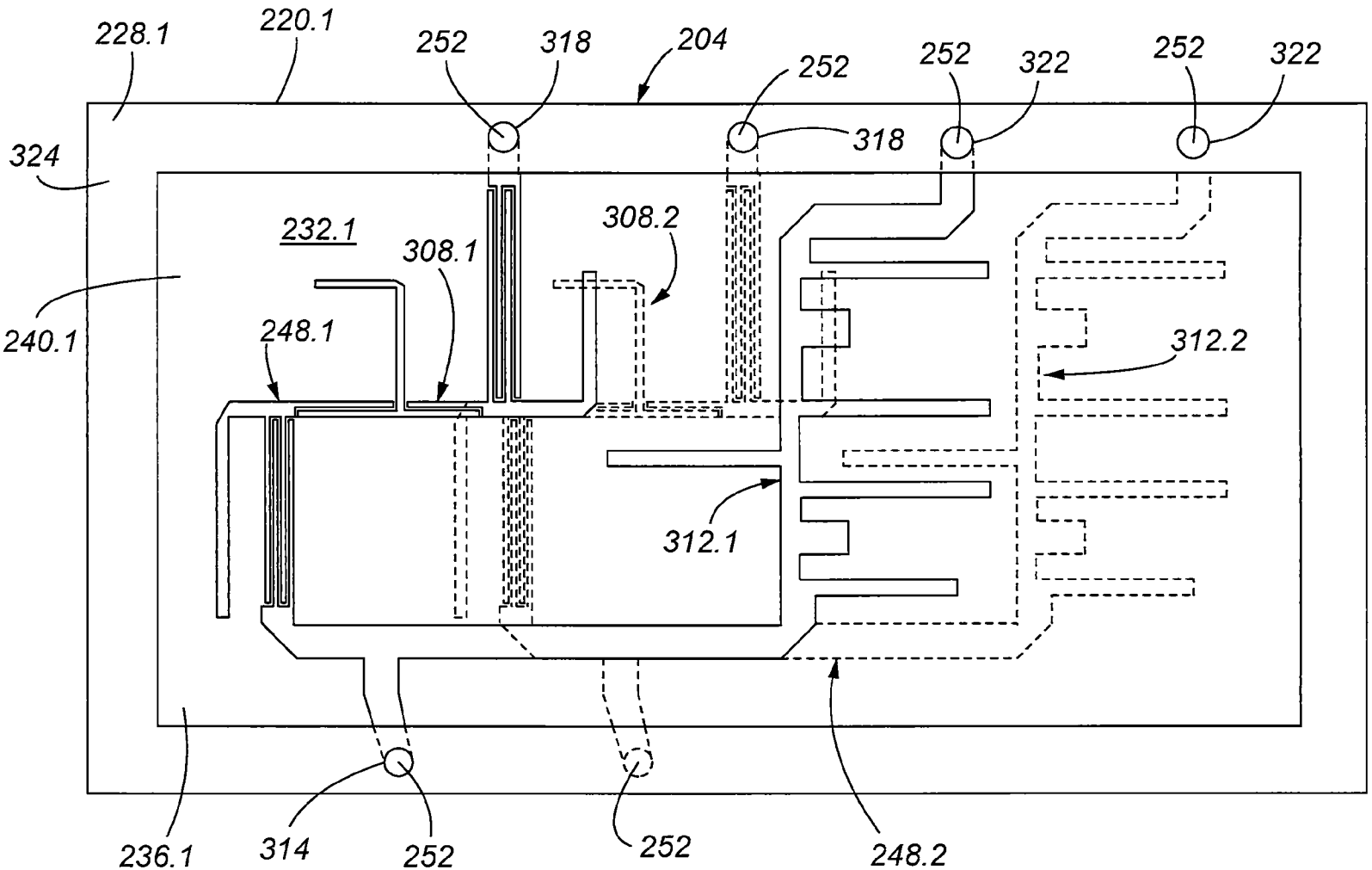
FIG. 5 is a plan view of an air loaded stripline assembly incorporating multiple stripline layers in accordance with embodiments of the disclosed invention.

FIG. 5 depicts the air loaded stripline assembly 204 of FIG. 4 in plan view along section line B-B. As shown, the substrate 228.1 of the first spacer layer 220.1 defines a frame 324 that extends about a periphery of the air loaded stripline assembly 204. Within the frame 324 is a cavity 232.1. The first stripline 248.1 is formed on the substrate 240.1 of the first stripline layer 236.1. In the example configuration depicted in the figure, the first stripline 248.1 comprises a first branch 308.1 and a second branch 312.1. For example, the first branch 308.1 may be associated with a first low-pass filter 112 and the second branch 312 may be associated with a first high-pass filter 116.

FIG. 5 also depicts with dotted lines the relative location of the second stripline 248.2 formed as part of the second stripline layer 236.2. In particular, it can be seen that the second stripline 248.2 is shifted laterally with respect to the first stripline 248.1. This shift allows the features of the first stripline 248.1 to be repeated when forming the second stripline 248.2, while providing space within the frames 324 of the spacer layers 220 for the necessary conductive vias 252. Accordingly, the second stripline 248.2 can include a first branch 308.2 and the second branch 312.2, where the first branch 308.2 is associated with a low-pass filter 112 and the second branch 312.2 is associated with a high-pass filter 116. Accordingly, the air loaded stripline assembly 204 of FIGS. 4 and 5 can provide multiple diplexers in a single assembly, for example in connection with a multiple element antenna.

Figure 6:
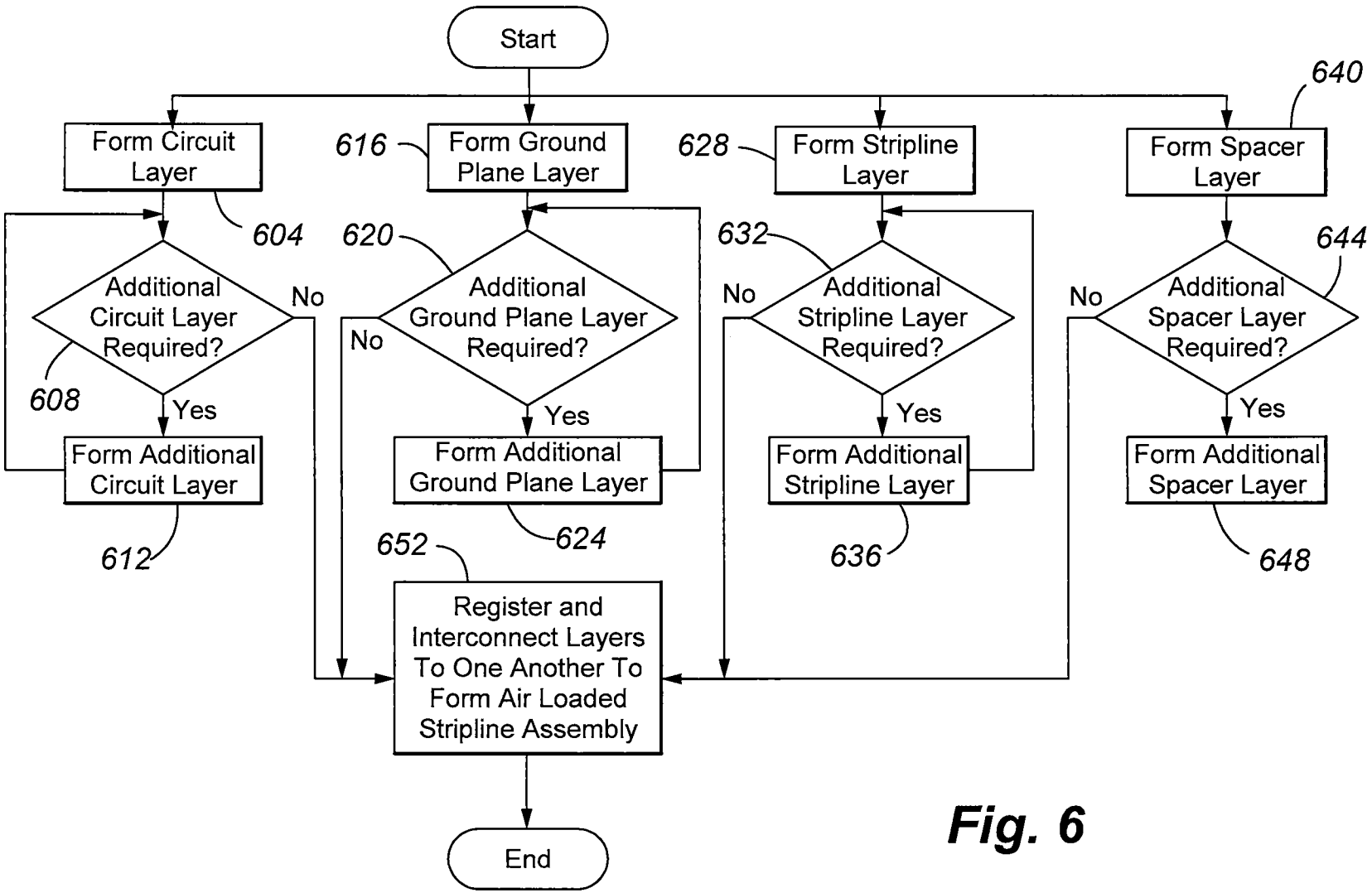
FIG. 6 is a flow chart depicting aspects of a method for providing an air loaded stripline assembly in accordance with embodiments of the disclosed invention.

FIG. 6 is a flowchart depicting aspects of a method for forming an air loaded stripline assembly 204 in accordance with embodiments of the present invention. After initiating the process, the various layers may be formed. Moreover, the step of forming the various layers can be performed in parallel. In one step, a circuit layer 404 is formed (step 604). In general, forming the circuit layer can comprise forming a laminated structure that includes conductive traces 408 on a substrate 412 that is associated with a ground plane 416. The conductive traces 408 can comprise pads or interconnections for establishing signal lines between components, and/or to provide mounting points for discrete components that are to be interconnected to the air loaded stripline assembly 204. Forming a circuit layer 404 can also include drilling and plating holes for conductive vias 252. Alternatively or in addition, a circuit layer may comprise a power and control layer 420. At step 608, a determination is made as to whether an additional circuit layer 404 is required. If an additional circuit layer 404 is required, that layer may be formed (step 612).

Another step in forming an air loaded stripline assembly 204 in accordance with embodiments of the present invention is the formation of a ground plane layer 208 (step 616). Formation of a ground plane layer 208 can include obtaining and sizing a laminated circuit board comprising a substrate 216 and a ground plane 212 on one or both sides of the substrate 216. Forming a ground plane layer 208 can additionally include forming one or more conductive vias, as required by the design of the air loaded stripline assembly 204. At step 620, a determination is made as to whether additional ground plane layers 208 are required. If additional ground plane layers 208 are required, those additional ground plane layers 208 may be formed (step 624).

Another step in the creation of an air loaded stripline assembly 204 in accordance with embodiments of the present invention is the formation of a stripline layer 236 (step 628). Formation of a stripline layer 236 can include forming one or more striplines 248 from a conductive layer laminated or otherwise interconnected to a substrate 240. For example, a conductive trace or traces 244 can be formed on a substrate 240 to define a stripline 248. The formation of the conductive traces 244 can include etching or mechanically removing conductive material from the substrate 240 of a piece of circuit board material. As further examples, the formation of conductive traces 244 in a substrate 240 may comprise the deposition of a conductive material onto a substrate. In general, any technique for forming a circuit board comprising conductive traces carried by a substrate can be employed. At step 632, a determination may be made as to whether additional stripline layers 236 are required. If additional stripline layers 236 are required, those additional stripline layers 236 may be formed (step 636).

A further step in the formation of an air loaded stripline assembly 204 in accordance with embodiments of the present invention, is the formation of a spacer layer (step 640). Forming a spacer layer 220 can include cutting a piece or layer of substrate material 228 to an appropriate size. In addition, in accordance with embodiments of the present invention, forming a spacer layer 220 includes removing or relieving at least a portion of the substrate material 228, to provide a void that will define a cavity 232 of the air loaded stripline assembly 204. Relieving a portion of the substrate 228 can include cutting a portion of the substrate 228 away to define a lateral and longitudinal extent of the void that will define a cavity 232. In accordance with embodiments of the present invention, the void is formed within a perimeter of the substrate 228, such that a frame 324 is created. Formation of a spacer layer 220 may additionally include the formation of conductive vias within the frame portion 324 of the spacer layer 220. At step 644, a determination is made as to whether additional spacer layers are required. If additional spacer layers 220 are required, such additional spacer layers 220 are formed (step 648).

After all of the required layers have been formed, they may be registered and interconnected to one another to form the air loaded stripline assembly 204 (step 652). Interconnecting the layers to one another may include applying an adhesive 224 to surfaces of the layers to bond them to one another, producing a stack of layers comprising the air loaded stripline assembly 204. Interconnection of the layers can further include the drilling and plating of the conductive vias 252.

Although particular examples of an air loaded stripline assembly 204 in accordance with embodiments of the present invention have been provided, it should be appreciated that variations and modifications are possible. For instance, an air loaded stripline assembly 204 in accordance with embodiments of the present invention can include any number of stripline layers 236. In addition, a stripline layer 236 can include any number of striplines 248 and/or stripline branches. Moreover, although use of an air loaded stripline assembly 204 in connection with a diplexer circuit 104 has been discussed, it should be appreciated that the air loaded stripline assembly 204 may be used in connection with any application in which an air loaded stripline is desired.

Particular advantages of an air loaded stripline assembly 204 in accordance with embodiments of the present invention include the relative ease of manufacture. In particular, embodiments of the present invention can be constructed using conventional printed circuit board techniques. In particular, any method for forming planar circuit elements can be utilized. Moreover, it should be appreciated that different materials may be used in constructing an air loaded stripline assembly 204. For example, layers incorporating flexible substrates can be used. Moreover, the use of flexible substrates can allow for the assembly 204 to be formed in a non-planar or partially non-planar configuration. In accordance with still other embodiments, the relieved portions of the assembly can extend to layers in addition to the spacer layers 220. For example, portions of a substrate 240 of a stripline layer 236 can be relieved. In particular, portions of the substrate 240 adjacent (but generally not underlying) the conductive trace or traces 244 forming the stripline 248 can be relieved, such that cavities 232 on either side of the stripline 248 are placed in communication with one another, forming a unitary cavity that extends around one or both sides of a stripline 248, as well as the top and bottom of the stripline or area containing the stripline 248.

The foregoing discussion of the invention has been presented for purposes of illustration and description. Further, the description is not intended to limit the invention to the form disclosed herein. Consequently, variations and modifications commensurate with the above teachings, within the skill or knowledge of the relevant art, are within the scope of the present invention. The embodiments described hereinabove are further intended to explain the best mode presently known of practicing the invention and to enable others skilled in the art to utilize the invention in such or in other embodiments and with various modifications required by the particular application or use of the invention. It is intended that the appended claims be construed to include alternative embodiments to the extent permitted by the prior art.

What is claimed is:

1. A device, comprising:

a first ground plane layer;

a first stripline layer, wherein the first stripline layer includes at least a first stripline, and wherein the first stripline of the first stripline layer includes a first geometric configuration;

a first spacer layer, wherein the first spacer layer is interconnected to the first ground plane layer on a first side of the first spacer layer, wherein the first spacer layer is interconnected to the first stripline layer on a second side of the first spacer layer, wherein at least a portion of the first stripline layer is separated from the first ground plane layer by a first cavity defined at least in part by a void in the first spacer layer;

a second ground plane layer;

a second spacer layer, wherein the second spacer layer in interconnected to the first stripline layer on a first side of the second spacer layer, wherein the second spacer layer is interconnected to the second ground plane layer on a second side of the second spacer layer, wherein at least a portion of the first stripline layer is separated from the second ground plane layer by a second cavity defined at least in part by a void in the second spacer layer;

a second stripline layer, wherein the second stripline layer includes at least a first stripline, wherein the first stripline of the second stripline layer includes the first geometric configuration, and wherein the first stripline of the second stripline layer is shifted laterally with respect to the first stripline of the first stripline layer;

a third spacer layer, wherein the third spacer layer is interconnected to the second ground plane layer on a first side of the third spacer layer, wherein the third spacer layer is interconnected to the second stripline layer on a second side of the third spacer layer, wherein at least a portion of the first stripline of the second stripline layer is separated from the second ground plane layer by a third cavity defined at least in part by the third spacer layer;

a third ground plane layer;

a fourth spacer layer, wherein the fourth spacer layer is interconnected to the second stripline layer on a first side of the fourth spacer layer, wherein at least a portion of the second stripline layer is separated from the third ground plane by a fourth cavity, and wherein the fourth spacer layer is interconnected to the third ground plane layer on a second side of the fourth spacer layer.

2. The device of claim 1, wherein the first stripline layer includes a dielectric substrate and a conductive trace, wherein the conductive trace forms the at least a first stripline.

3. The device of claim 2, wherein the first stripline layer is a printed circuit board.

4. The device of claim 1, wherein the first stripline layer includes a dielectric substrate and a conductive trace, and wherein conductive trace forms the first stripline and a second stripline.

5. The device of claim 4, wherein at least the first stripline is interconnected to a conductive via that extends through the first spacer layer.

6. The device of claim 4, wherein the first and second striplines are interconnected to one another at a common port.

7. The device of claim 6, wherein the first stripline is interconnected to a first conductive via, wherein the second stripline is interconnected to a second conductive via, wherein the common port is interconnected to a third conductive via, and wherein all of the first, second and third conductive vias extend through the first spacer layer.

8. The device of claim 4, wherein a first end of the first stripline is interconnected to a first end of the second stripline at a common port, wherein the first stripline forms a high pass filter and is terminated at a second end at a high frequency port, wherein the second stripline forms a low pass filter and is terminated at a second end at a low frequency port.

9. The device of claim 1, further comprising:

a circuit layer, wherein the circuit layer includes a first conductive element;

a conductive via extending through the first spacer layer, wherein the conductive via interconnects the first conductive element of the circuit layer to the first stripline of the first stripline layer.

10. The device of claim 9, wherein the first conductive element of the circuit layer comprises a plurality of pads for interconnecting at least a first discrete electronic component.

11. An air loaded stripline assembly, comprising:

a first circuit board, including:

a first conductor forming at least a portion of a first filter;

a substrate;

a second circuit board, including:

a ground plane;

a substrate;

a first spacer interconnecting the first circuit board and the second circuit board, wherein the first spacer has a void defining a first cavity, and wherein the first cavity is interposed between at least a portion of the first circuit board and the ground plane of the second circuit board;

a third circuit board, including:

a first ground plane;

a second ground plane;

a substrate;

a second spacer interconnecting the first circuit board and the third circuit board, wherein the second spacer has a void defining a second cavity, and wherein the second cavity is interposed between at least a portion of the first circuit board and the first ground plane of the third circuit board;

a fourth circuit board, including:

a first conductor forming at least a portion of a second filter, wherein the first filter and the second filter have the same geometric configuration, and wherein the first conductor of the fourth circuit board and the first conductor of the first circuit board are laterally shifted with respect to one another;

a substrate, a third spacer interconnecting the third circuit board to the fourth circuit board, wherein the third spacer has a void defining a third cavity, and wherein the third cavity is interposed between at least a portion of the fourth circuit board and the second ground plane of the third circuit board;

a fifth circuit board, including:

a ground plane;

a substrate;

a fourth spacer interconnecting the fourth circuit board to the fifth circuit board, wherein the fourth spacer has a void defining a fourth cavity, and wherein the fourth cavity is interposed between at least a portion of the fourth circuit board and the ground plane of the fifth circuit board.

12. The assembly of claim 11, wherein at least a portion of the substrate of at least one of the first circuit board and the second circuit board is interposed between the at least a portion of the first conductor of the first circuit board and the ground plane of the second circuit board.

13. The assembly of claim 11, wherein the first conductor of the first circuit board includes a first branch that forms at least a portion of a first low pass filter, wherein the first conductor of the first circuit board further includes a second branch that forms at least a portion of a first high pass filter, wherein the first conductor of the fourth circuit board includes a first branch that forms a portion of a second low pass filter, and wherein the first conductor of the fourth circuit board further includes a second branch that forms at least a portion of a second high pass filter.

14. The assembly of claim 13, further comprising:

a conductive via, wherein the via extends from the first conductor of the third circuit board to the first conductor of the second circuit board.

15. A method for forming an air loaded stripline, comprising:

providing a first substrate;

forming a first stripline on the first substrate within at least a first area of the first substrate to form a first stripline layer, wherein the first stripline is in a first geometric configuration;

providing a first spacer layer;

removing at least a portion of the first spacer layer corresponding to at least a portion of the first area of the first stripline layer;

interconnecting the first spacer layer to the first stripline layer;

providing a first ground plane layer;

interconnecting the first spacer layer to the first ground plane layer, wherein the first spacer layer is interposed between the first stripline layer and the first ground layer, and wherein a first cavity corresponding to the removed portion of the first spacer layer is formed between at least a portion of the first stripline and the first ground plane layer;

providing a second spacer layer;

removing at least a portion of the second spacer layer corresponding to at least a portion of the first area of the first stripline layer;

interconnecting the second spacer layer to the first stripline layer;

providing a second ground plane layer;

interconnecting the second spacer layer to the second ground plane layer, wherein the second spacer layer is interposed between the first stripline layer and the second ground plane layer, and wherein a second cavity is formed between at least a portion of the first stripline and second ground plane layer;

providing a third spacer layer;

removing at least a portion of the third spacer layer;

providing a second substrate;

forming a second stripline on the second substrate within at least a first area of the second substrate to form a second stripline layer, wherein the second stripline is in the first geometric configuration;

interconnecting the second stripline layer to the third spacer layer, wherein the second stripline shifted laterally with respect to the first stripline, and wherein a second cavity corresponding to the removed portion of the third spacer layer is formed adjacent at least a portion of the second stripline.

16. The method of claim 15, further comprising:

forming a first via through the first ground plane layer and the first spacer layer, wherein the via interconnects to a first port associated with the first stripline;

forming a second via through at least the first ground plane layer, the first spacer layer, the first stripline layer, the second spacer layer, and the second spacer layer, wherein the via interconnects to a second port associated with the second stripline, wherein the second via and the second port are shifted laterally with respect to the first via and the first port.

17. The device of claim 1, wherein the first stripline of the first stripline layer is confined to a first plane, and wherein the first stripline of the second stripline layer is confined to a second plane.

18. The device of claim 1, wherein the first geometric configuration includes at least one of an open-circuited stub, an inter-digital capacitor, and one or more branches.

19. The device of claim 1, wherein the first stripline layer and the second stripline layer are each formed on a flexible substrate material.

* * * * *